United States Patent [19]

Huettemann

[11] Patent Number: 4,841,702

[45] Date of Patent: Jun. 27, 1989

[54] INSULATED CONCRETE BUILDING PANELS AND METHOD OF MAKING THE SAME

[76] Inventor: Erik W. Huettemann, 285 Mill Rd., Madison, Ala. 35758

[21] Appl. No.: 158,476

[22] Filed: Feb. 22, 1988

[51] Int. Cl.[4] ..... E04C 1/06; E04C 1/28; E04C 1/40

[52] U.S. Cl. ..... 52/309.12; 52/809

[58] Field of Search ..... 52/309.12, 809

[56] References Cited

U.S. PATENT DOCUMENTS

| | | | |
|---|---|---|---|
| 3,232,017 | 2/1966 | Prusinski et al. | 52/809 X |
| 3,382,637 | 5/1968 | Longinotti | 52/309.12 |
| 4,075,805 | 2/1978 | Bongiovanni | 52/309.12 |
| 4,090,336 | 5/1978 | Carroll | 52/309.12 |
| 4,512,126 | 4/1985 | Walston | 52/309.12 |
| 4,625,472 | 12/1986 | Busick | 52/309.12 |
| 4,625,484 | 12/1986 | Oboler | 52/309.12 |
| 4,674,242 | 6/1987 | Oboler et al. | 52/309.12 |

*Primary Examiner*—John E. Murtagh
*Assistant Examiner*—Anthony W. Williams
*Attorney, Agent, or Firm*—C. A. Phillips

[57] ABSTRACT

A three-layer insulated concrete panel includes as the middle layer an insulating slab having grooves which provide a form for casting of concrete supporting ribs integral with a layer of concrete cast over the grooved face. A layer of material, such as particle board, is bonded to the ungrooved face of the slab. In preparing the panel, the slab is placed on a flat surface with the particle board face down. Forms are then placed in spaced-apart relation to panel edges, and concrete is cast into the forms and grooves and over the grooved panel face. The insulating slab provides a form for casting of supporting ribs and is permanently retained in the panel, giving it a high insulating value.

25 Claims, 3 Drawing Sheets

INSULATED CONCRETE BUILDING PANELS AND METHOD OF MAKING THE SAME

TECHNICAL FIELD

This invention relates generally to building panels and more particularly to prefabricated concrete building panels.

BACKGROUND OF THE INVENTION

Precast concrete panels are being used for a variety of application in building construction owing to savings obtained from reductions in construction time and forming requirements. Precast panels are normally prepared by casting them in suitable molds on a horizontal surface, which may be an already cast floor slab at the construction site. Upon curing, the panels are placed in vertical position by means of a crane using "tilt-up" construction techniques and are bolted in place. One type of panel which has gained widespread acceptance is a waffle-shaped panel in which weight savings are obtained, consistent with high strength, by providing a network of intersecting reinforced ribs projecting outward from one face of the panel. The ribs are cast integrally with the remainder of the panel using a special mold. Typically, a panel having the strength of an eight-inch structural section may be obtained using the equivalent of only three and one-half inches of concrete.

Various disadvantages and limitations are exhibited by existing waffle-shaped panels. The as-cast panels are not insulated, and if insulation is to be provided, it must be installed later, typically by inserting fiberglass batts into the voids between the ribs and enclosing the batts by attaching an insulating foam board to the rib ends. Other measures such as attaching a foam board on the flat panel face with an adhesive or nailing furring strips to the panel rib ends with concrete nails have also been used. Such measures are laborintensive and add substantially to costs. In addition, the existing panels have been limited in their application for use as ceiling panels owing to their inability to meet strength requirements for long overhead spans.

SUMMARY OF THE INVENTION

The present invention is directed to building panels having a self-supporting, rigid insulating slab provided with a plurality of grooves or channels located in one face of the slab and having concrete cast over that slab face, forming supporting ribs in the grooves and a layer disposed over the face. The insulating slab serves a dual purpose in that it acts as a mold for the concrete during casting, and it is permanently retained in the finished panel as highly effective insulation, filling the voids between panel ribs and providing a layer that covers the rib ends. The face of the slab opposite the concrete layer preferably has a flat sheet of interior wall material secured thereto, thus providing a three-layered structure which, when installed as a wall section, includes an outer layer of concrete, a middle layer of insulation with supporting concrete ribs extending partially through the insulation, and an interior layer that protects the insulation and provides a surface suitable for application of any desired interior finish. By providing increased thickness of the insulating slab, panels embodying the invention may be made stronger for use as overhead ceilings and upper-story floors. These panels are characterized by their relatively light weight and their insulating and load-bearing capabilities. In addition, fabrication expenses are minimized, owing to avoidance of any need for expensive forms or other special casting equipment.

It is therefore an object of the present invention to provide concrete building panels having a layer of structural concrete and a layer of insulation integrally formed therewith.

Another object is to provide a building panel having lightweight, high strength and a high insulating value.

Still another object is to provide high-strength insulated concrete panels usable for ceilings as well as walls.

Another object is to provide waffle-shaped concrete panels that are insulated as-cast.

Yet another object is to provide a method of preparing concrete building panels wherein the need for use of specialized forms is avoided.

Another object is to provide a method of preparing insulated concrete panels wherein the insulation itself serves as a form for retaining cast concrete.

DESCRIPTION OF THE PREFERRED EMBODIMENT

Figure 1:
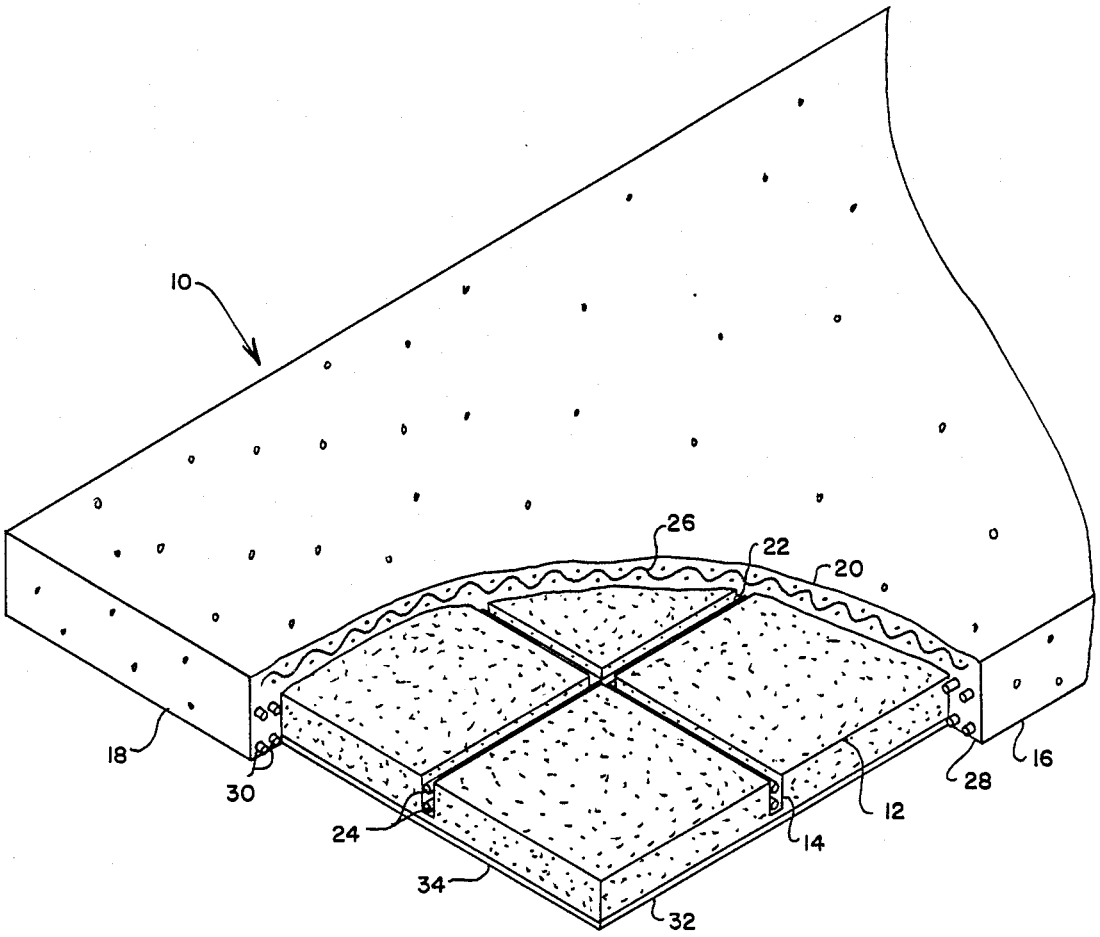
FIG. 1 is a pictorial view, partially broken away, showing a building panel embodying the invention.

Referring to FIG. 1 of the drawings, a three-layer building panel 10 is shown. The middle layer 12 of the panel is a rigid slab of insulating material such as foam polystyrene having a density of one to two pounds per cubic foot. Grooves 14 of rectangular cross section are disposed in one face of the slab parallel to side 16 and end 18, the grooves intersecting one another and forming a grid or waffle pattern. A layer 20 of cast concrete is located over the grooved face of the slab with ribs 22 of concrete integral with layer 20 extending into the grooves. Reinforcing bars 24 are positioned within and along the length of the grooves, concrete being cast around the bars in accordance with usual practice. Wire mesh reinforcement 26 is incorporated in concrete layer 20 for additional strength. A concrete edge frame 28 of rectangular cross section encloses the panel edges, forming sides 16 and ends 18. Edge frame 28 also has reinforcing bars 30 incorporated therein along the length of the frame. The edge frame, like the reinforcing ribs, is cast integrally with layer 20. Face 32 of the slab opposite the grooved face has bonded thereto a layer 34 of nailable material such as wooden particle board or plywood sheet.

Figure 2:
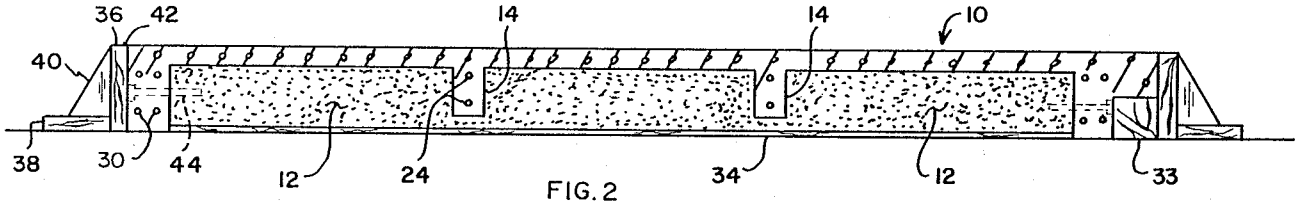
FIG. 2 is a cut-away view of a cast panel, with edge forms in place.

FIG. 2 shows a panel 10 in as-cast condition prior to separation from forms around its edges. Necessary steps and proedures for preparation of the panel are explained herein with reference to this figure. The panel shown has an overall thickness of eight inches. In preparing the panel, a six-inch thick slab or block 12 of foam polystyrene is first adhesively bonded to a $\frac{3}{8}$-inch thick sheet 34 of wood particle board. Grooves 14 are then cut into the opposite face of the insulating slab by means such as routing. For the panel shown, the grooves are one and a half inches thick and five inches deep and have uniform depth and a rectangular cross section. The grooved slab is then placed on a flat horizontal surface with the particle board face down, and forms are positioned around the panel edges. The forms as shown include a board 36 placed on its edge and secured to another board 38 placed flat on the casting floor, with braces 40 being provided as required. Upper edge 42 of board 36 controls the thickness of concrete layer 20; thus, the width of board 36 is selected to provide the desired layer thickness. For the panel shown, a thickness of $1\frac{5}{8}$ inches is obtained. In general, a thickness of $\frac{1}{2}$ to 3 inches may be used. The form boards are, of course, placed level and at a selected distance away from edges of the insulating slab. Form boards at the panel end shown at the left side of the drawing are separated a distance of four inches from that panel end and thus provide a concrete edge frame thickness of four inches. At the right side of the drawing, the form boards are spaced eight inches from the panel edge, and a 4×4 timber insert 33 is provided along the length of the form adjacent to the bottom of the form. This results in a 4×4 notch along the bottom of the panel edge, which facilitates assembly of finished panels as will be explained below. Spacers 44 are disposed to maintain separation between the form boards and the slab. Two reinforcing bars 24 are placed in each groove one above the other and are supported by means of conventional spacers (not shown). Four reinforcing bars 30 are also located between forms and edges of the slab and are supported by spacers.

Concrete is then poured into the assembled forms, filling the grooves and edge regions and providing a layer over the top face of the slab. The upper surface is worked using conventional techniques to provide a flat finished surface. Upon curing, the edge forms are removed and a finished panel is obtained.

Figure 3:
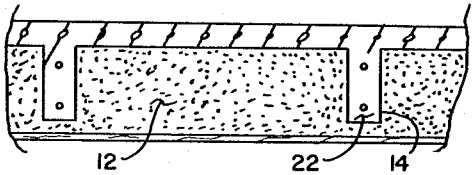
FIG. 3 is a sectional view of an embodiment of the invention wherein a thicker slab of insulation is employed.

FIG. 3 shows an embodiment of the invention wherein the panel is made thicker to provide greater strength for applications such as long-span ceiling panels. This panel is essentially the same as the panel as described with respect to FIGS. 1 and 2 except that the insulating slab 12 is two inches thicker and the grooves 14 are cut two inches deeper to provide wider ribs 22. Also, the edge frame is correspondingly wider.

Figure 5:
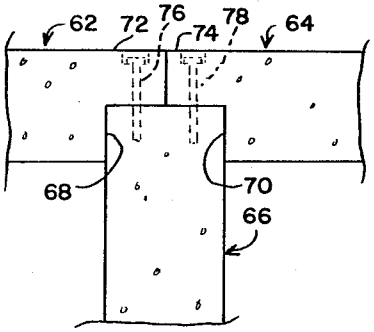
FIGS. 4, 5, and 6 are cut-away planar views showing how the separate panels may be joined together in construction of a building.
Figure 4:
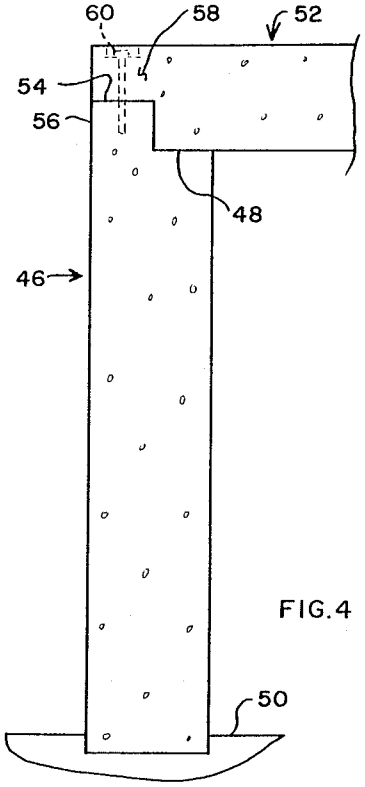

FIGS. 4 and 5 show methods of assembling panels into building structures using rabbetted joints formed by overlapping of panel edges having notched-out corners formed in the casting process as described above for the panel end shown at the right side of FIG. 2. In FIG. 4, panel 46 is shown erected in vertical position on footing 50. The top, inside end of the wall panel has a corner notch 48 extending along the width of the panel end, the notch thickness being one-half the panel thickness. The outside end of the panel has a projecting shoulder 56 extending across the panel end and corresponding in size to notch 48. Ceiling panel 52 at the bottom side of its left-hand end also has a notch 54 extending across the panel end and a projecting shoulder 58 at the top side of the panel end and corresponding in size to notch 54. The two panels are shown assembled with shoulders partially overlapped to form a rabbetted joint. The panels are secured together by bolts or screws 60 extending through shoulder 58 and into shoulder 56.

FIG. 5 shows an assembly for joining ceiling panels 62 and 64 to a load-bearing internal wall panel 66. Panels 62 and 64 have notches 68 and 70 and projecting shoulders 72 and 74 as described above for panel 52 of FIG. 4. The assembled panels are secured together by bolts 76 extending through panel 62 and bolts or screws 78 extending through panel 74, both sets of bolts or screws being anchored in the upper end of panel 66.

Figure 6:
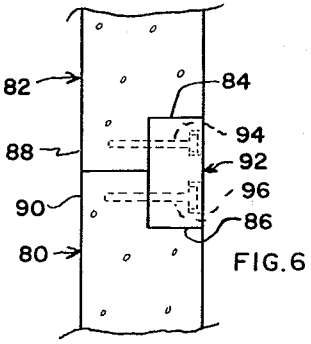

FIG. 6 shows an assembly of wall panels in edge-to-edge relationship. Panel 80 has a notch 86 and projecting shoulder 90 extending across its end, and panel 82 has a notch 84 and shoulder 88 across its end. In this assembly, shoulders 88 and 90 are placed in contact with one another, leaving a gap on the other face of the panels defined by notches 84 and 86. A separate member 92 having a cross section defined by the gaps and extending the length of the joint is disposed in the gap and secured to panels 80 and 82 by bolts or screws 94 and 96, respectively. The separate member may be solid cast concrete or concrete cast around an insulating slab. Individual panels for a specific application may be prepared to have notches and shoulders in appropriate locations by including or omitting inserts 33 in the casting forms as shown at the right side of FIG. 2.

Figure 7:
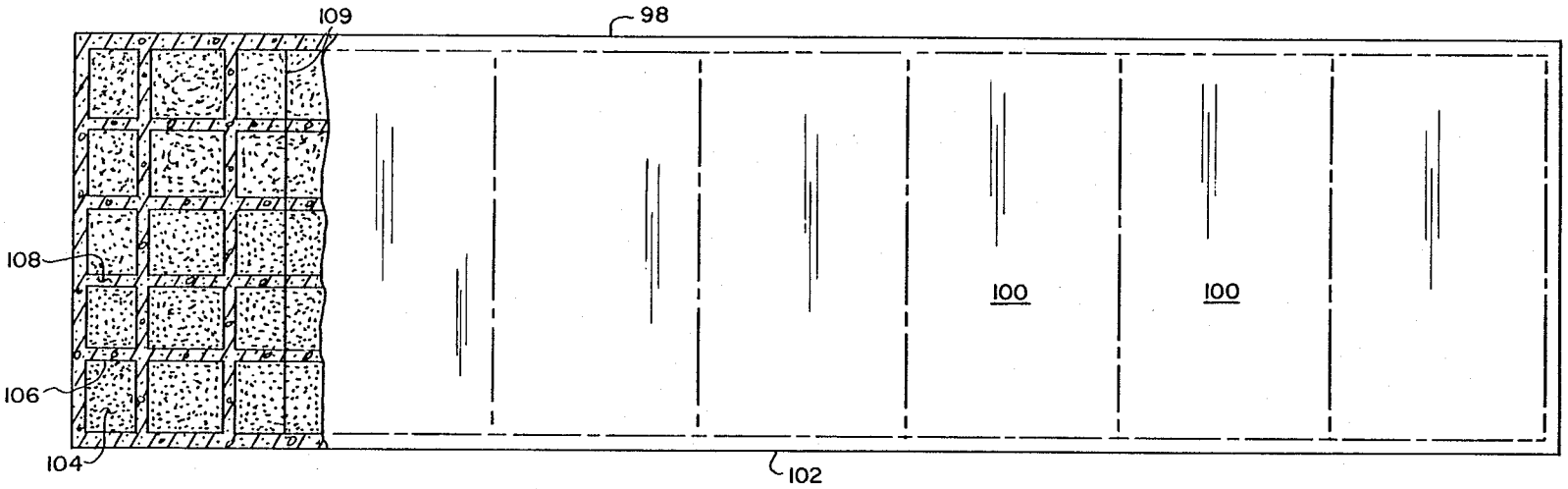
FIG. 7 is a planar view of an elongated panel made up of multiple individual units.
Figure 8:
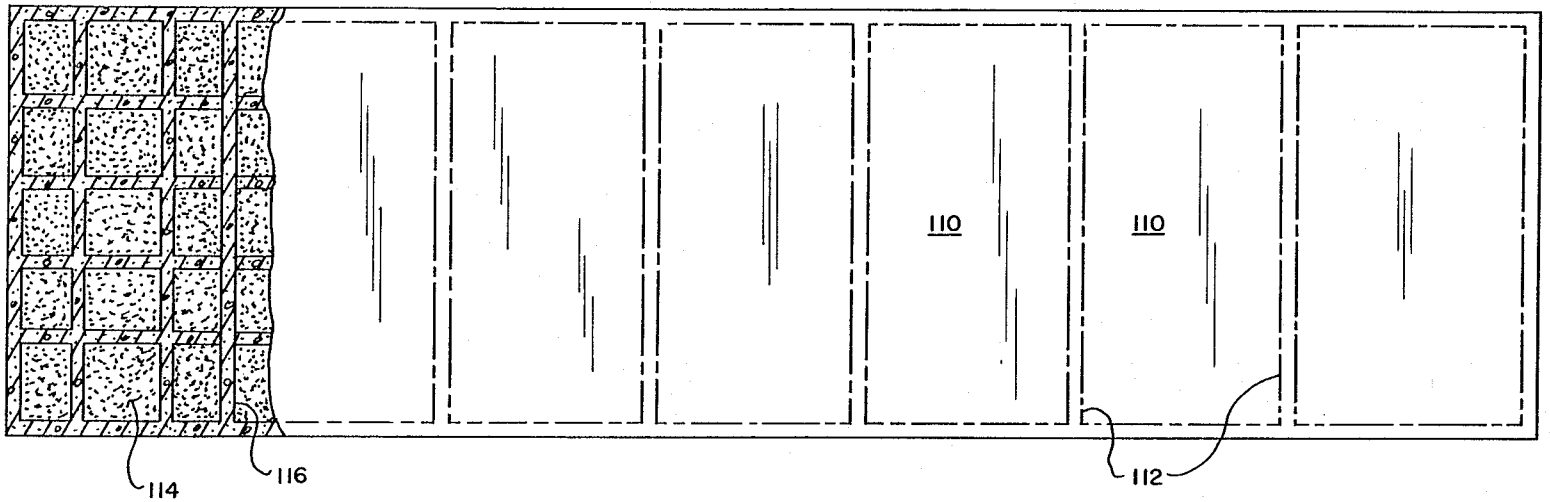
FIG. 8 is a planar view of an elongated panel made up of individual units and having concrete frame members between the units.

FIGS. 7 and 8 show embodiments of the invention wherein an elongated panel structure is made up to include multiple individual units, in each case seven, in an integral cast structure. In FIG. 7, elongated panel 98 generally includes the equivalent of seven panels as described above with reference to FIGS. 1 and 2, except that the individual units 100 are disposed with their longer sides adjacent one another within a cast outer frame 102. In preparing elongated panels according to this embodiment, individual insulating slabs 104 having an intersecting network of grooves 106 in one face and particle board (not shown) bonded to the opposite face would be placed to form a rectangular array with the particle boards face down on a flat surface and with the longer sides of adjacent slabs having their edges in contact. Forms would then be placed around the outer edges of the array and reinforcing bars and mesh inserted in the same manner as for preparing the individual panels units as described above. Individual panel units in the elongated panel would be held in place by reinforcing ribs 108 that extend across the interface 109 between adjacent panel units. The outer frame, ribs, and concrete layer would be cast integrally in the same manner as described above.

FIG. 8 shows an embodiment similar to FIG. 7 except that individual panels units 110 are spaced apart, and transversely extending concrete frame members 112 are provided in the spaces between individual units. In preparing elongated panels according to this embodiment, the grooved insulating slabs 114 having particle boards 115 bonded to the ungrooved face are placed particle board face down and spaced apart a distance corresponding to the desired thickness of vertical frame members. Edges 116 of individual slabs serve as forms for casting of the concrete vertical frame members. The frame members between slabs, like the ribs and outer frames, are formed integral with the rest of the concrete portion of the panel. The transverse frame members between the individual units provide increased support and enable use of the elongated panels for highstrength applications.

Figure 9:
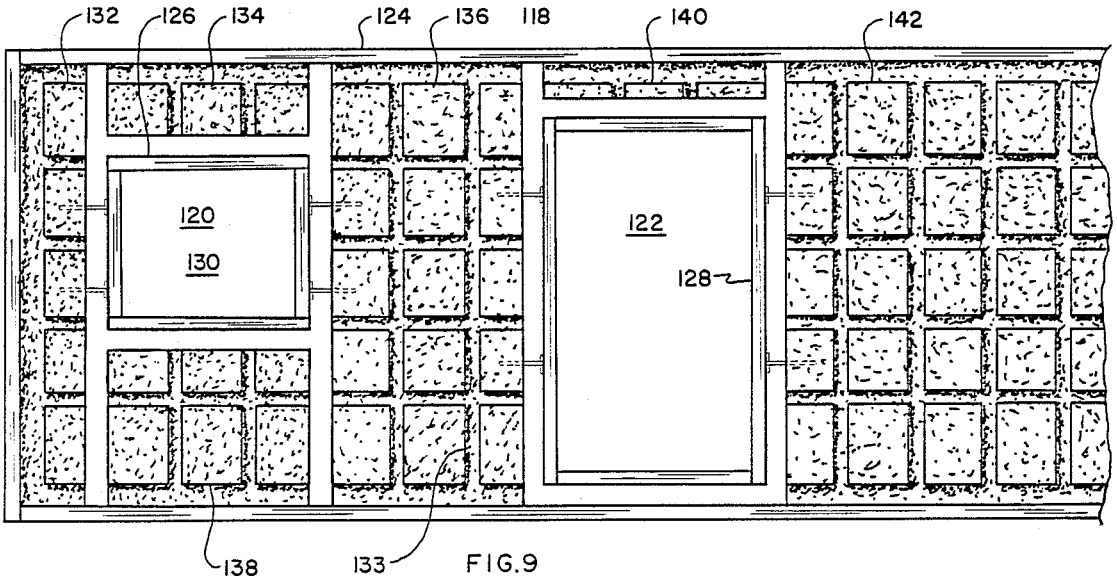
FIG. 9 is a planar view showing the preparation a of panel wherein block-out forms are used to produce openings for doors and windows.

In FIG. 9, an elongated panel 118 is shown in an embodiment wherein openings 120 and 122 are provided for a window and door, respectively. The panel assembly is shown in condition for casting with edge forms 124 being spaced apart from panel edges and block-out forms 126 and 128 spaced apart from insulating slab edges at the window and door openings. In preparing this panel, a particle board 130 is laid down, and pieces 132, 134, 136, 138, and 140 of insulating slab, having grooves 133, are cut to form the desired pattern around the openings and are then bonded to the particle board. Reinforcement is placed in position, and concrete is then cast into the grooves and frame forms and over the exposed slab faces, providing an integral cast layer, ribs, and edge frames around the window and door. Upon curing, the particle board across the openings is then cut away. Openings as required for utilities or other purposes can also be obtained by providing suitably sized block-out forms. Inserts for lifting and positioning the panels should also be placed in the form prior to casting.

Numerous variations in dimensions and materials for the various layers may be employed within the scope of this invention. In general, overall panel size may be varied from 4 by 8 feet to 24 by 40 feet. As described above with respect to FIGS. 7 and 8, larger, elongated panel units may be made by placement of individual units side by side within a single outer frame. The grooves in the insulating slab, and the ribs formed therein, are preferably arranged in an intersecting network or waffle pattern, forming uniform squares with sides in the range of one to two and one-half feet long. Depth and width of the grooves and thus the width and thickness of the ribs cast therein may be varied depending upon strength and insulation requirements. In general, a groove depth is selected such as to leave at least one inch of the slab intact, with the remaining thickness of insulation being sufficient to avoid the presence of thermal bridges at the embedded edges of the ribs.

The insulating slab must be rigid and strong enough to allow cutting of grooves and to maintain its shape during casting of concrete. Foamed polystyrene having a density of one to two pounds per cubic foot is suitable for this purpose. Other type of foam material which meet the abovestated requirements may also be used. A foam slab thickness of 4 to 24 inches may be used, depending on the application, with thicker slabs providing greater strength and a higher insulating value.

The material used for the layer on the face opposite the concrete layer may also be varied, depending on the particular application. In most cases, a nailable, wood-based sheet material such as particle board, plywood, wafer board, or masonite, is preferred to facilitate interior finishing and to provide a base for ready application of sheet rock by nailing. Fiberglass sheet material may also be used. The sheet material is preferably bonded to a face of the insulating slab by means of a suitable adhesive as the first step in making the panels. A sheet material thickness of $\frac{3}{8}$ to 1 inch is preferred, with greater thicknesses being used where the sheet is intended to support heavy items such as wall cabinets, shelves, or the like. Additional layers of material may be added to the panel if desired.

Composition of the concrete used in the panel is not limited to a particular mixture, and conventional structural concrete mixtures may be generally used. As described above, the concrete is shown reinforced with steel reinforcing bars and wire mesh. Other reinforcing means such as plastic bars or reinforcing fibers may also be employed. Conventional techniques may be used in casting the concrete and working the outer surface as required. Any desired surface finish may be obtained by applying suitable materials on the surface or using working techniques to provide a particular texture.

Curing of the cast concrete may be carried out by using conventional methods, with a curing time of 12 hours being preferred. To avoid cracking due to cooling too rapidly, especially in cold weather, insulation may be placed over the exposed concrete face during curing.

By using interior sheet material that has been treated with a fire retardant, the panels may be rendered virtually fire-proof, thus providing another important advantage, particularly for ceilings where conventionally used wooden materials allow fires to spread rapidly.

I claim:

1. A load-bearing building panel comprising:

a rigid slab of insulating material having a first face, a second face, and a plurality of edges, said first face having defined therein a plurality of grooves extending substantially into said slab and forming channels for containing supporting ribs; and concrete integrally cast into said grooves, over said first face, and outside of and in contact with said edges, forming supporting ribs within said grooves and integral therewith a layer of concrete covering said first face and edge frames outside said slab edges.

2. A building panel as defined in claim 1 including a layer of nailable, wood-based sheet material covering and secured to the second face of said slab.

3. A building panel as defined in claim 2 wherein said slab is a rectangular solid and has four edges perpendicular to said slab faces.

4. A building panel as defined in claim 3 wherein said grooves have a uniform depth and a rectangular cross section.

5. A building panel as defined in claim 4 wherein said grooves are disposed parallel to panel edges intersecting one another, providing a waffle-shaped pattern.

6. A building panel as defined in claim 5 wherein said layer of finishable protective material comprises nailable sheet material.

7. A building panel as defined in claim 5 wherein said insulating slab comprises foamed polystyrene having a density of one to two pounds per cubic foot.

8. A building panel as defined in claim 5 including reinforcing means disposed in said concrete.

9. A building panel as defined in claim 8 wherein said reinforcing means comprises concrete reinforcing bars disposed in said ribs and edge frame and wire mesh disposed in said concrete layer.

10. A load-bearing structural panel comprising:

a rigid, solid, rectangular-shaped slab of insulating material having a first face and a second face and four edges;

said first face having defined therein a plurality of grooves extending substantially into said slab and arranged parallel to edes of the slab, intersecting one another and forming a waffle-shaped pattern;

a layer of finishable material covering said second face of said slab and bonded thereto;

concrete filling said grooves and forming ribs therein;

a layer of concrete covering said first face;

a concrete edge frame enclosing said edges of said slab; and said concrete ribs, concrete layer, and concrete edge frame being integrally cast.

11. A structural panel as defined in claim 10 wherein said grooves have a rectangular cross section and a uniform depth such that the thickness of the slab remaining under the grooves is at least about one inch.

12. A structural panel as defined in claim 11 wherein said finishable material is a nailable board.

13. A structural panel as defined in claim 12 wherein said board is about $\frac{1}{4}$ to 1 inch thick.

14. A structural panel as defined in claim 13 wherein said slab is 4 to 24 inches thick.

15. A structural panel as defined in claim 14 wherein the slab-face-covering layer of concrete is $\frac{1}{2}$ to 3 inches thick.

16. A structural panel as defined in claim 15 wherein said edge frame along at least one side of said slab has a width equal to the thickness of the panel and has a notch with a square cross section and having sides equal to one-half the thickness of the slab, the notch extending the length of said side and being located on the face of the panel opposite to the concrete layer.

17. The method of making a load-bearing building panel comprising:

providing a rectangular slab of insulating material;

bonding a sheet of nailable, wood-based sheet material to one face of said slab so as to cover that face;

cutting grooves in th\ opposite face of said slab so as to provide a waffle-shaped pattern therein;

placing the grooved slab on a flat surface within the grooved face up;

placing forms around the edges of the slab and spaced apart therefrom; and casting concrete into said grooves, over said grooved face of the slab and into the space between said forms and said slab edges so as to produce integral concrete forming a layer covering one face of the slab, ribs extending the slab and an edge frame enclosing the slab edges.

18. The method of claim 17 including the step of placing reinforcing means in said grooves, edge forms, and above the grooved face prior to casting said concrete.

19. The method of claim 18 including the step of providing an insert within and extending along the length of at least one side of said edge frame, the insert having a square cross section and a thickness equal to one-half the thickness of the panel so as to provide a notch on the face of the panel opposite the concrete layer.

20. A load-bearing building panel comprising:

a plurality of rectangular slabs of insulating material, each slab having a first face and a second face and four edges generally perpendicular thereto, said slabs being disposed in a rectangular array with their first and second faces coplanar with one another and with edges of adjacent slabs being slightly spaced apart from one another;

at least one groove in said first face of said slabs and extending across said array transverse to said spaced-apart edges; and concrete integrally cast into the spaces between said adjacent slab edges, into said grooves, and outside of and in contact with slab edges at the outside of said array, forming supporting ribs in the spaces between slabs and in said groove, a layer of concrete covering said first face and edge frames outside said slab edges at the outside of said array, said concrete layer, ribs, and edge frame including reinforcing means.

21. A building panel as defined in claim 20 including a layer of nailable, wood-based sheet material covering and secured to the second face of said slabs.

22. A building panel as defined in claim 21 wherein said layer of nailable, wood-based sheet material is at least $\frac{3}{8}$-inch thick.

23. A load-bearing building panel comprising:

a plurality of rectangular slabs of insulating material of uniform thickness disposed edge-to-edge in a rectangular array, the array having a first face and a second face and outside edges;

said first face having defined therein a plurality of grooves for containing supporting ribs; and concrete integrally cast into said grooves, over said first face, and outside of and in contact with said outside edges, forming supporting ribs in said grooves and integral therewith a layer of concrete covering said first face and edge frames outside said outside edges, said concrete layer, ribs, and edge frame including reinforcing means.

24. A building panel as defined in claim 23 including a layer of nailable, wood-based sheet material covering and secured to the second face of said slabs.

25. A building panel as defined in claim 24 wherein said layer of nailable, wood-based sheet material is at least $\frac{3}{8}$-inch thick.

* * * * *